United States Patent [19]

Onoda et al.

[11] Patent Number: 4,627,701

[45] Date of Patent: Dec. 9, 1986

[54] CORONA DISCHARGER SYSTEM

[75] Inventors: Shigeyoshi Onoda, Yokohama; Akihiro Nomura, Kawasaki; Morikazu Mizutani, Tokyo; Shinji Kanemitsu, Ichikawa; Mototada Toriumi, Yokohama; Fumio Nishino, Tokyo, all of Japan

[73] Assignee: Canon Kabushiki Kaisha, Tokyo, Japan

[21] Appl. No.: 784,368

[22] Filed: Oct. 4, 1985

Related U.S. Application Data

[62] Division of Ser. No. 494,867, May 16, 1983, Pat. No. 4,575,221.

[30] Foreign Application Priority Data

May 20, 1982 [JP] Japan ..... 57-85608
Jul. 21, 1982 [JP] Japan ..... 57-127027
Sep. 30, 1982 [JP] Japan ..... 57-171905

[51] Int. Cl.[4] ..... G03G 15/02

[52] U.S. Cl. ..... 355/3 CH; 250/325; 361/229

[58] Field of Search ..... 355/3 CH, 14 CH, 3 R, 355/3 DR; 250/324, 325, 326; 361/213, 225, 229, 300

[56] References Cited

U.S. PATENT DOCUMENTS 3,117,501 1/1964 Oliphant .
4,320,957 3/1982 Brown et al. ..... 355/3 CH
4,466,729 8/1984 Iwata ..... 355/3 CH

FOREIGN PATENT DOCUMENTS 56-77858 6/1981 Japan ..... 355/3 CH

OTHER PUBLICATIONS

*IBM Technical Disclosure Bulletin,* vol. 19, No. 7, Dec. 1976, Wesley et al., "Corona Adjustment", pp. 2433–2434.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A process kit is detachably mounted in the main body of an image forming apparatus and includes a housing in which a photosensitive member, a corona discharger and a developing device are mounted and held as a unit, the housing including an optical opening formed therein upstream of the corona discharger for conducting a homogeneous light to the photosensitive member to eliminate any remaining charge thereon and an opening of exposure for conducting a light of information to the photosensitive member, the exposure opening being located between the corona discharger and the developing device.

10 Claims, 19 Drawing Figures

CORONA DISCHARGER SYSTEM

This is a division of application Ser. No. 494,867, filed May 16, 1983, now U.S. Pat. No. 4,575,221.

BACKGROUND OF THE INVENTION

The present invention relates generally to a process kit including process means detachably mounted in a primary apparatus for forming images and also to an image forming apparatus utilizing such a process kit.

U.S. Pat. No. 3,985,436 discloses a detachable process means in the form of a kit containing a photosensitive member and others which have a limitation in durability due to the fact that the deterioration proceeds as the time passes, thereby the consumption goods can easily be exchanged. For example, the photosensitive member may effectively be exchanged together with a development device having a limited durability due to consumption of toner, a cleaner that has been filled with the used toner, a corona discharger that is subject to a difficulty in discharging due to the deposited toner, and others.

Such a structure that the running stores and consumption goods can detachably be mounted within the main body of the apparatus is herein called a process kit. Such a process kit may comprise process means including, in combination, a photosensitive member, a development device, a cleaning device, a corona discharger and others.

The process kit can simply be replaced by a new process kit on the deterioration of the photosensitive member, etc. since it can be composed of all the running stores. This is desirable for users because of the process kit reduced in cost.

SUMMARY OF THE INVENTION

It is therefore an object of the present invention to provide an improved corona discharger system for image formation and which may also be incorporated in a process kit. The present invention provides a system in which a position of a corona wire of the discharger system, which effects corona discharge on a latent image carrying member, may be automatically kept at an optimum condition. In the system, the corona wire, itself, presses a wire positioning member onto the latent image carrying member, so that the wire may be exactly positioned with a predetermined distance with respect to the carrying member.

According to one aspect of the invention, there is provided a corona discharger system comprising a corona wire, a support for both ends of the corona wire, a member movable into facing relation with the corona wire and having a surface which will hold an electrostatic latent image and a corona wire positioning member located between said surface and the mounted corona wire and always biased toward said surface by the tension of the corona wire. The positioning wire may have a roller facing the surface. The system may further comprise guide means to adjust the range of movement of said corona wire positioning member.

DETAILED DESCRIPTION OF THE PREFERRED EMBODIMENTS

The present invention will now be described by way of example with respect to an electrophotographic copying machine.

Figure 1:
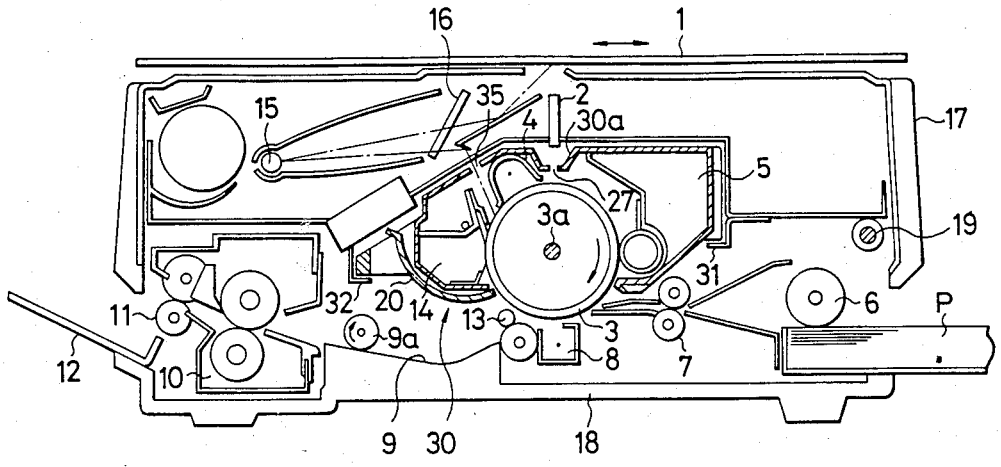
FIG. 1 is a cross-sectional view of a copying machine in which a process kit according to the present invention is mounted.
Figure 2:
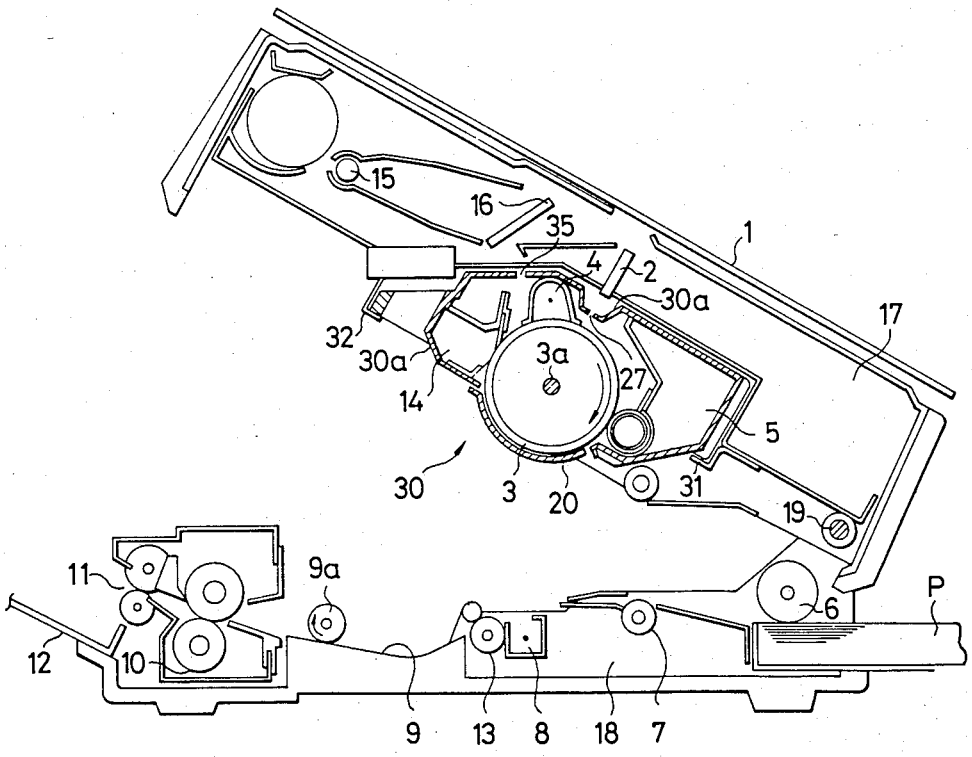
FIG. 2 is a cross-sectional view showing the copying machine of FIG. 1 with the upper housing thereof being opened.

FIGS. 1 and 2 show the construction of an electrophotographic copying machine in which the present invention is embodied. FIG. 2 shows the machine in its open position. As shown in FIG. 1, the electrophotographic copying machine comprises a transparent table 1 on which an original document is placed and which can move in the opposite directions as shown by double-headed arrow, and an array of image forming elements 2 which serves to slit expose an image of the original document on the table 1 to a photosensitive drum 3, the photosensitive drum 3 consisting of a photosensitive OPC layer and an electrically conductive substrate, and rotating in the direction shown by arrow in FIG. 1. The machine also includes a corona discharger 4 for uniformly charging the photosensitive drum and a development device 5 for developing, by the use of toner, an electrostatic latent image which has been formed on the charged drum through the array 2.

On the other hand, a transfer sheet P is fed to the surface of the drum 3 by means of a feed roller 6 and resister rollers 7. When the transfer sheet P reaches the drum, the toner image thereon is transferred onto the transfer sheet under the action of a transfer charger 8. Thereafter, the sheet is separated from the drum under the action of separation means 13 and then moved to a fixing device 10 through a guide 9 by means of a roller 9a which is located in the path of sheet. The toner image on the sheet is fixed by the fixing device 10 and then the sheet is discharged onto a tray 12 through discharge rollers 11. The remaining toner particles on the photosensitive drum 3 are collected by means of a cleaning device 14. The machine further includes a lamp 15 used to irradiate the original document and a filter 16 for absorbing thermic rays from the lamp.

As shown in FIG. 2, the copying machine is divided into an upper housing 17 and a lower housing 18 which are connected with each other by means of a pivot 19. The upper housing 17 is adapted to rotate upwardly about the pivot 19. Within the upper housing 17 is disposed image forming means which includes the irradiating lamp 15, the image forming element 2, the photosensitive drum 3, the development device 5, the cleaning device 14 and others. On the other hand, the lower housing 18 receives the feed roller 6, the transfer charger 8, the separation means 13, the guide 9, the fixing device 10 and others all of which are disposed in the path of sheet movement.

In the illustrated embodiment, further, the development device 5, cleaning device 14, charger 4 and others located around the photosensitive drum 3 are enveloped by another housing, that is, a light-shielding wall formed separately from the upper and lower housings to form a process kit 30. If it is desired to replace the photosensitive drum 3 by a new photosensitive drum, the process kit 30 is changed as a unit. The maintenance operation is therefore relieved.

The process kit 30 can be mounted in the machine by moving the process kit along rails 31 and 32 located in the machine in the direction parallel to the rotational axis of the drum 3. Removal of the kit from the machine will be described hereinafter.

Figure 3:
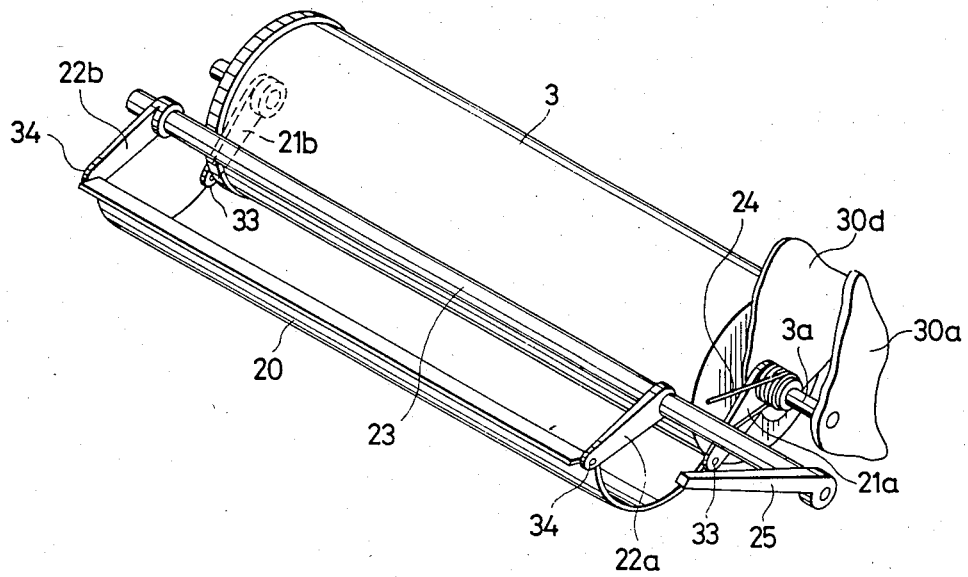
FIG. 3 is a perspective view, partially broken, of an mechanism for opening and closing a drum cover in the process kit.

Below the process kit 30 is located a protective cover 20 of an opaque material which may be the same one as the wall portion 30a of the process kit, such as black-colored ABS resin material. The protective cover 20 serves also as a light shielding member for blocking any light incident upon the exposed surface of the drum 3. FIG. 3 shows the detailed construction of the cover 20. The drum cover 20 is rotatably connected at the opposite ends on one side to swing arms 21a and 21b through pivots 33. The swing arms 21a and 21b are rotatably supported by the rotational shaft 3a of the photosensitive drum 3. On the other side, further, the drum cover 20 is rotatably connected at the opposite ends to other swing arms 22a and 22b through pivots 34. The swing arms 22a and 22b are fixedly secured to a shaft 23 to which an actuating lever 25 is fixedly secured at one end. The swing arms 21a and 21b are biased by a spring 24 counter-clockwise as viewed in FIG. 3. Reference numeral 30d denotes part of the inner cover in the process kit 30.

In the above arrangement, if the actuating lever 25 is moved clockwise through a mechanism which will be described hereinafter, the shaft 23 is rotated clockwise to rotate the cover 20 clockwise through the swing arms 22a and 22b fixed at one end to the shaft 23 into a position that the cover 20 is retracted apart from the peripheral surface of the photosensitive drum 3.

Figure 4:
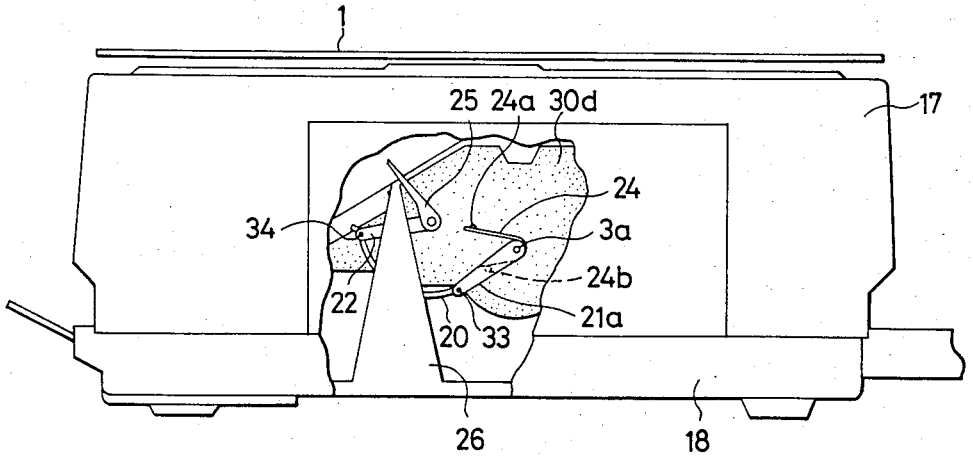
FIG. 4 is a side view showing the drum cover in its closed position.

As shown in FIG. 4, the lower housing 18 includes a projection 26 formed therein which engages with the actuating lever 25. A spring 24 engages at one end with a projection 24a on the inner cover 30d and at the other end with a projection 24b on the arm 21a. Thus, if the process kit 30 is mounted in the machine and when the upper housing 17 is closed, the projection 24 causes the actuating lever 25 to rotate clockwise, so that the cover 20 will automatically be retracted away from the pheripheral surface of the drum 3 to expose the same for forming images.

Figure 5:
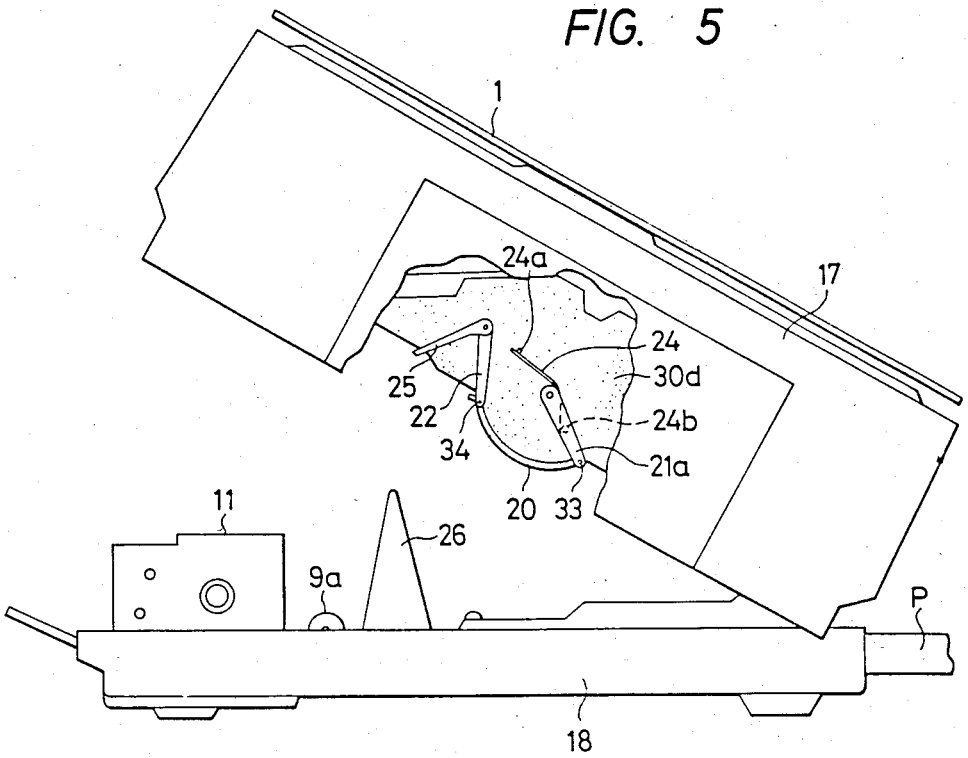
FIG. 5 is a view similar to FIG. 4, showing the drum cover in its open position.

On the contrary, if the upper housing 17 is upwardly moved to open the machine, the actuating lever 25 disengages from the projection 26 as shown in FIG. 5. The swing arms 21a and 21b are thus rotated counter-clockwise under the action of the spring 24 to pivot the drum cover 20 counter-clockwise near the peripheral surface of the photosensitive drum 3 so that the exposed portion of the photosensitive drum 3 not covered by the wall portion 30a will be closed. Thus, the peripheral surface of the photosensitive drum 3 is shielded from the external light and is also protected from damaged due to any external force.

It is understood from the foregoing that in accordance with the present invention, the exposed surface of the photosensitive member in the process kit can be shielded from the external light even when the machine is in its open position. This is accomplished in maintenance and inspection and on treating any jamming of transfer sheet.

In the illustrated embodiment, if it is wanted to remove the process kit from the machine, the upper housing 17 is first rotated upwardly to bring the machine into its open position as shown in FIG. 2. The process kit 30 is then moved on the rails 31 and 32 along the axis of the photosensitive drum 3. At this point, the exposed portion of the drum 3 is shielded from the external light as described hereinbefore. There is however an opening 27 formed in the wall portion 30a of the process kit at a position facing to the image forming element 2 for conducting an image of the original document to the photosensitive drum 3. The opening 27 is located near the top portion of the peripheral surface of the photosensitive drum. If the process kit is left as it is after it has been removed from the machine, any external light tends to be incident upon the surface of the photosensitive drum through the opening 27. This result in optical memory on the photosensitive drum which tends to reduce images in quality.

In order to overcome such a problem, the process kit according to the present invention includes a light shielding plate for covering the opening 27 which will be described in connection with FIG. 6.

Figure 6:
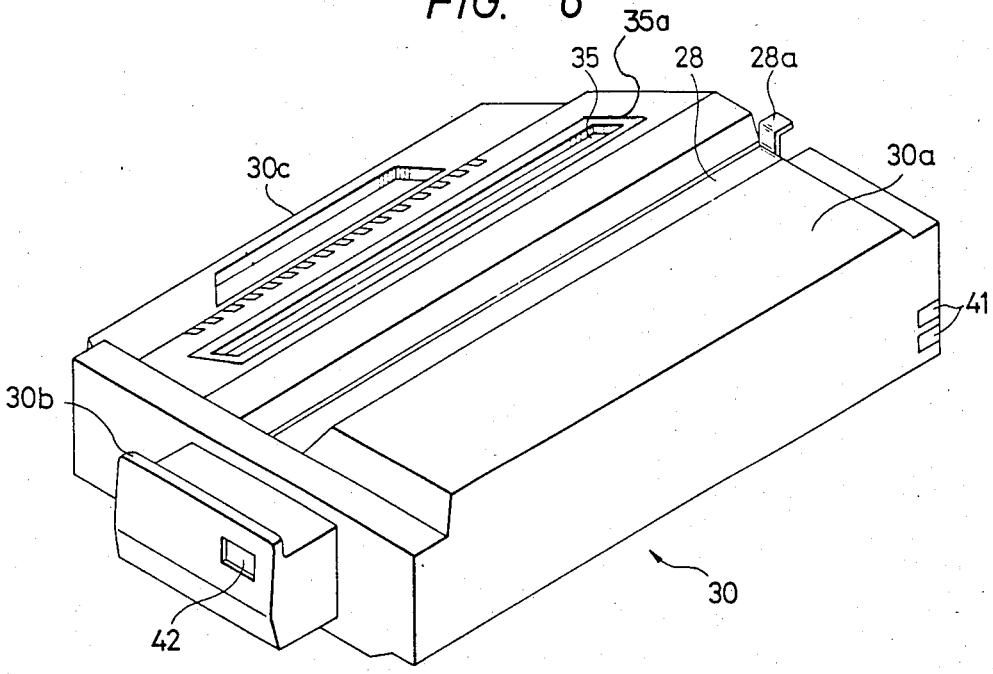
FIG. 6 is a front perspective view of the process kit.
Figure 7:
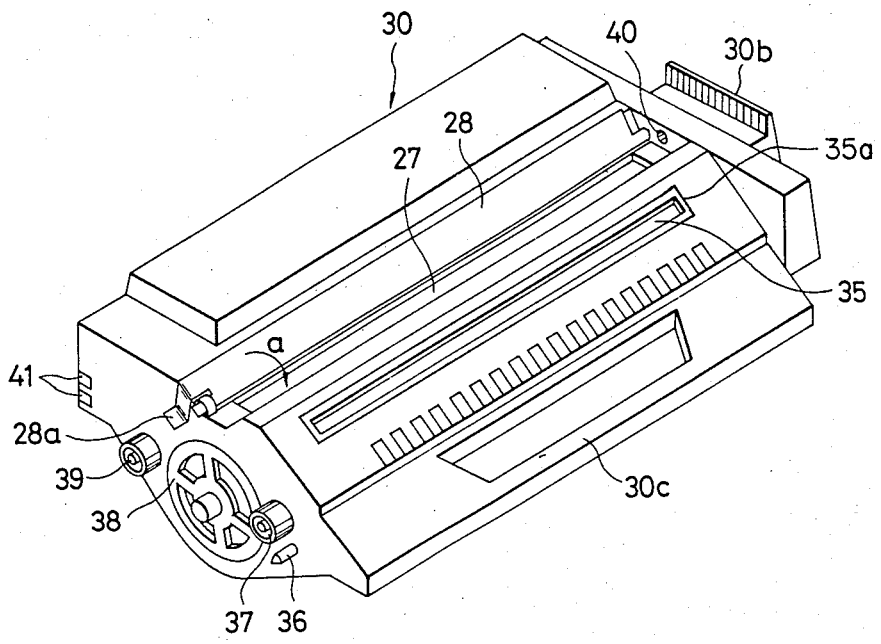
FIG. 7 is a rear perspective view of the process kit.

FIG. 6 shows the forward portion of the process kit according to the present invention which has been removed from the machine while FIG. 7 shows the rearward portion of the same which includes a connection used to couple the process kit with the machine.

The process kit includes a grip 30b used to move it outwardly on the rails 31 and 32 and a handle 30c utilized to lift the process kit removed from the machine. The process kit 30 also includes an opening 27 formed therein at the top which is used for exposure. In the illustrated embodiment, a pivotable light shielding plate 28 is disposed along the length of the opening 27 at one side edge. The light shielding plate 28 is made of the same light shielding material as that of the wall portion 30a, such as ABS resin material. When the light shielding plate 28 is moved in the direction shown by arrow in FIG. 7 to close the opening 27, the photosensitive drum 3 can completely be shut off from any external light. At the rear edge of the plate 28, a projection 28a curved at right angle is provided.

FIG. 7 shows the light shielding plate 28 in such a position that it opens the opening 27 immediately before or during the process kit is mounted in the machine. When the process kit is removed from the machine, the light-shielding plate 28 is rotated in the direction shown by arrow in FIG. 7 into its closed position. As a result, a right-angle projection 28*a* formed on the plate 28 at one end will extend upwardly as shown in FIG. 6. In such a state, if it is attempted to insert the process kit 30 into the machine, the projection 28*a* would engage with the image forming element 2 in the machine so that the process kit cannot be inserted into the machine. Thus, an operator can know that the opening 27 is still closed by the light shielding plate 28. If the process kit should be mounted within the machine as the opening 27 is still closed by the light shielding plate 28, no image would be formed in the copying machine since any light does not reach the photosensitive drum.

As shown in FIGS. 6 and 7, the opening 27 is located in the depressed part on the top of the process kit housing between the corona discharger 4 and the development device 5. By providing the opening 27 in such a position, the peripheral surface of the photosensitive drum 3 can be protected from directly engaging with any external matter such as hands during handling. Furthermore, the light shielding plate 28 can be reduced in its angular motion to facilitate the operation thereof.

The process kit 30 further includes another opening 35 for conducting a light for pre-exposure to the portion of the photosensitive drum 3 between the corona discharger 4 and the cleaning device 14. This opening 35 functions to conduct part of the light from the lamp 15 to the drum as shown in FIG. 1. Thus, a particular lamp for pre-exposure is not required in the process kit. Since the lamp for pre-exposure is higher in durability, it is undesirable to assemble it into the process kit as a running store. Further, the externally located lamp can overcome various problems created due to the rise of temperature in the process kit. Although the opening 35 is of an opened area smaller than that of the opening 27, the photosensitive drum may be adversely affected even by any light incident thereupon through the opening 35. Since the opening 35 does not pass any light of image but a spot-like light, it may be closed by an opalesque fixed plate 35*a* other than a movable plate as the light shielding plate 28. Alternatively, any colored transparent plate transmitting a light of wavelength to which the photosensitive drum will not be responsive may be used.

Opaque materials which are suitable for use in the process kit and can completely block the light include Noryl resin, polycarbonate resin, ABS resin, metal, rubber and the like. Alternatively, a transmissible resin material may be used in place of the above opaque materials if the transmissible material absorbs or reflects a light of wavelength to which the photosensitive layer of the drum is responsive. A resilient seal of an opaque material such as moltplane, felt or the like may be located between the opening and the light shielding plate which is movable or rotatable relative to the opening so that the light shielding function will more be improved. Further the shielding cover covers the periphery of the photosensitive member, it functions to protect the photosensitive from damage.

As shown in FIG. 7, the process kit 30 includes, at the rearward portion, a pin 36 for properly positioning the process kit in the machine, a connector 37 for supplying the charger 4 with a high voltage, a gear 38 for driving the photosensitive drum 3 therethrough, and a connector 39 for applying a bias voltage to the development device 5. The gear 38 includes teeth operably engaging with those of a drive gear in the machine to transmit a drive to the drum 3.

The process kit 30 can accurately be positioned by causing a pin (not shown) in the machine to fit into a positioning aperture 40 formed in the wall of the process kit at the side opposite to the pin 36.

The process kit 30 can automatically change the amount of light of the image of an original at the side of the machine dependent on the characteristics of a photosensitive drum mounted in each process kit. Thus, photosensitive drums of various characteristics can easily and simply be replaced by one another to form stable images at all times. This can be attained by such a mechanism as shown in FIGS. 6 and 7. The mechanism includes notches 41 formed in the outer wall of the process kit and corresponding detection means such as microswitches provided in the machine body. By closing any one of these notches 41 depending upon the characteristics of the photosensitive drum, the presence or absence of that notch is detected by any microswitch which in turn generates a signal. In the illustrated embodiment, two notches 41 are formed in the process kit so that four modes will be provided by combining the presence and absence of notches.

Counting means for indicating the duration for which a process kit has been used is located within the grip 30*b* which is used on removing the process kit. Thus, the grip 30*b* also serves as a cover for the counting means. The counting means includes a gear wheel driven by the rotating shaft of the photosensitive drum and an indicating gear wheel driven by the first-mentioned gear wheel through a plurality of reduction gears. The indicating gear wheel has three colored zones, that is, blue, yellow and red zones which are provided on the side of the indicating gear wheel. The blue zone indicates that the process kit is still sufficiently used; the yellow zone warns that the process kit approaches its limitation of use; and the red zone indicates that the process kit must be replaced by a new process kit. Part of each of these colored zones can be observed by the operator through a window 42 formed in the grip as shown in FIG. 6.

Figure 8:
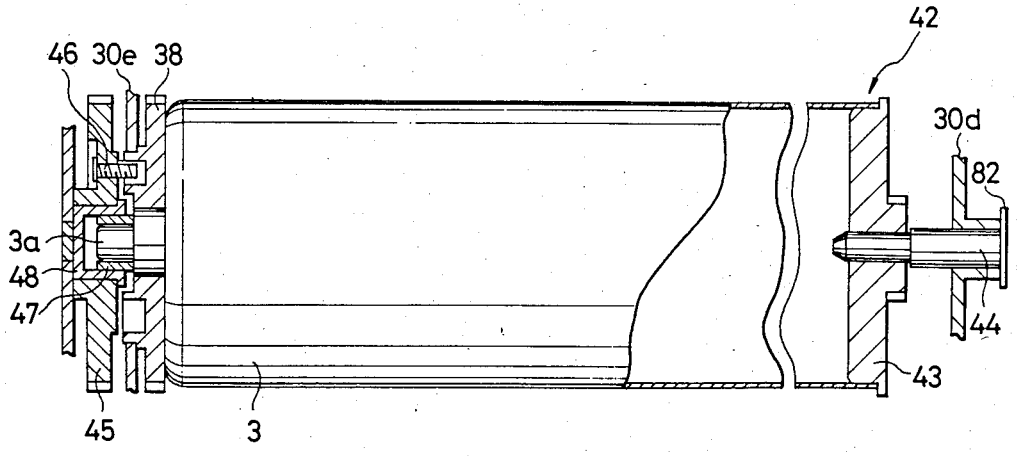
FIG. 8 is a front cross-section of a member supporting a photosensitive drum.

FIG. 8 is a front view, partly broken, of the photosensitive drum 3. The photosensitive drum 3 is made of aluminum and rotatably located at the center of the process kit. The photosensitive drum 3 has a boss 3*a* formed therein at one end as by impact molding. The opposite open end 42 of the drum is closed by a flanged cap 43 which is rotatably supported by a stub shaft 44 fixed to the kit housing. A power transmitting gear 38 is fixedly secured to the boss 3*a* of the drum 3 and rotatably supported in the bore of the kit housing. As shown in FIG. 7, the power transmitting gear 38 has radial ribs with which a pin 46 on a gear 45 mounted on the machine engages to rotate the gear 38 with the rotation of the gear 45 such that the drum 3 will be rotated. A bearing 47 is press-fitted over the boss 3*a* of the drum 3 and engage in a recess 48 of the machine housing to center the drum at the inner end thereof. The power transmitting gear 38 has teeth engaging with those of a development sleeve which will be described hereinafter. Thus, the power transmitting gear 38 functions to drive the development sleeve and a raking member 99 (FIG. 19) in the cleaning device.

As described hereinbefore, the process kit includes the corona discharger, development device and cleaning device which are disposed around the photosensitive drum.

Figure 9:
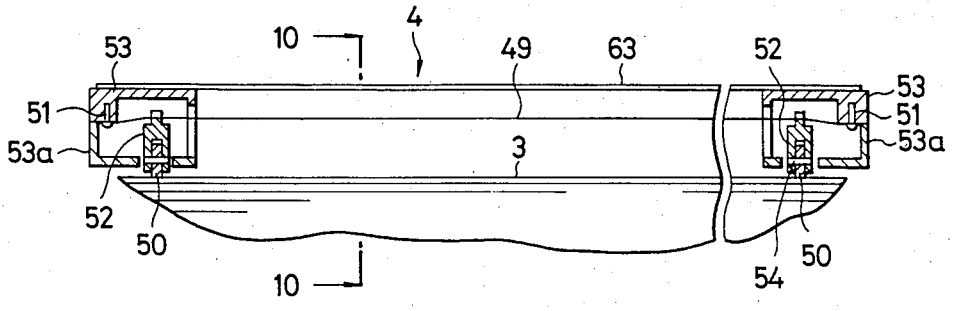
FIG. 9 is a front cross-section of a corona discharger.
Figure 10:
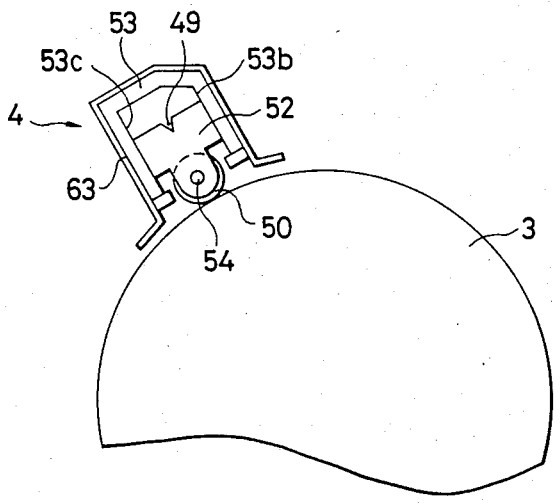
FIG. 10 is a cross-sectional view of the corona discharger, taken along a line 10—10 in FIG. 9.

FIG. 9 is a front cross-section of the corona discharger and FIG. 10 is a cross-sectional view taken along a line 10—10 in FIG. 9.

The corona discharger 4 has its primary structure comprising a shield case 63, a discharging wire 49 and block portions 53 on which the discharging wire 49 is mounted.

Concretely speaking, the discharging wire 49 is spanned between the blocks 53 at a position spaced away from the photosensitive drum (a member to be charged) 3 by a distance which is equal to a predetermined height minus the total tolerance of the components or more. The opposite ends of the wire 49 is fixedly secured to the blocks 53 by rivets 51. Each of the blocks 53 receives means for positioning the discharging wire which is a slide piece 52 movable in the direction perpendicular to the photosensitive drum. Each of the slide pieces 52 has a V-shaped notch formed therein at the top for receiving the discharging wire 49.

Each of the slide pieces 52 includes, at the lower end, a roller 50 which is rotatably supported by an axle 54 mounted on the lower end of the slide piece 52. The roller 50 is in rolling contact with the surface of the photosensitive drum 3. The slide piece 52 can be guided perpendicularly to the photosensitive drum 3 along the vertical inner walls **53*b* and 53*c* of the corresponding block 53 as seen from FIG. 10**.

Each of the slide pieces 52 is so designed that the distance between the V-shaped notch and the lower edge of the roller is equal to a proper distance between the discharging wire and the periphery of the photosensitive drum 3.

In such an arrangement, if the corona discharger 4 is mounted within the process kit relative to the photosensitive drum, the rollers 50 contact with the photosensitive drum 3 so that the slide pieces 52 will be forced upwardly to position the discharging wire 49 exactly.

Figure 11:
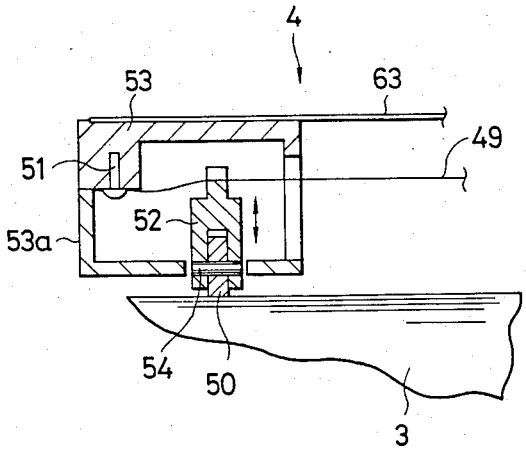
FIG. 11 is an end cross-sectional view of the corona discharger.

FIG. 11 is an enlarged cross-section of one of the block portions in the above corona discharger. In this figure, reference numeral 54 designates the rotational axle of the roller 50 which is fixedly secured to the corresponding slide piece 52.

Thus, the discharging wire 49 in the illustrated corona discharger can be positioned in an exact position spaced away fron the peripheral surface of the photosensitive drum 3 by the use of the rollers 50 which engage with the surface of the photosensitive drum 3.

Figure 12:
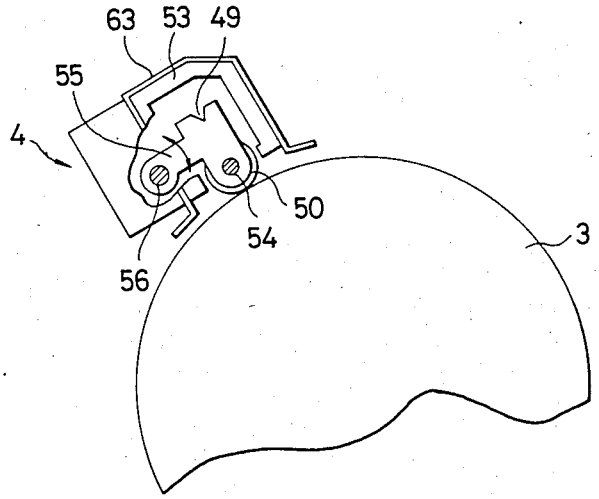
FIG. 12 is a side cross-sectional view of a modification of the corona discharger shown in FIG. 11.

FIG. 12 is a side cross-section of a modification of the means for positioning the discharging wire.

Although the embodiment shown in FIGS. 10 and 11 includes the slide pieces 52 which are guided along the inner walls of the blocks, this modification includes pieces 52 movable perpendicularly relative to the surface of the photosensitive drum, each of which includes an arm 55 extending laterally therefrom and supported pivotably by a guide shaft 56. Even in the modification shown in FIG. 12, the distance between the V-shaped notch for limiting the discharging wire 49 in its spatial position and the lower edge of the roller 50 contacting with the photosensitive drum 3 is determined on the basis of setting the length of the piece and the position of the roller in which it is supported. When the corona discharger is set, therefore, the distance between the discharging wire and the photosensitive drum can similarly be established without any "after-adjustment".

Although the above-mentioned embodiments have been described with reference to the rollers which are in contact with the photosensitive drum, non-rotating parts may be in contact with the surface of the photosensitive drum if they are made of a low-friction material. In such a case, the non-rotating parts may be formed integrally to the slide pieces. Although the V-shaped notches have been provided for positioning the discharging wire, any other structure may be used if it can restrain the discharging wire from moving relative to the slide pieces when they are moving. Separate elements for restraining the movement of the wire may be mounted on the slide pieces with no notch or groove for receiving the discharging wire.

Where the slide pieces are moved too far upwardly to change the tension in the discharging wire, the wire may be secured at one end to the slide piece through a spring. If the upward movement of the slide pieces can be absorbed by the wire on its elongation, no spring is required resulting in easy assembly.

Figure 13:
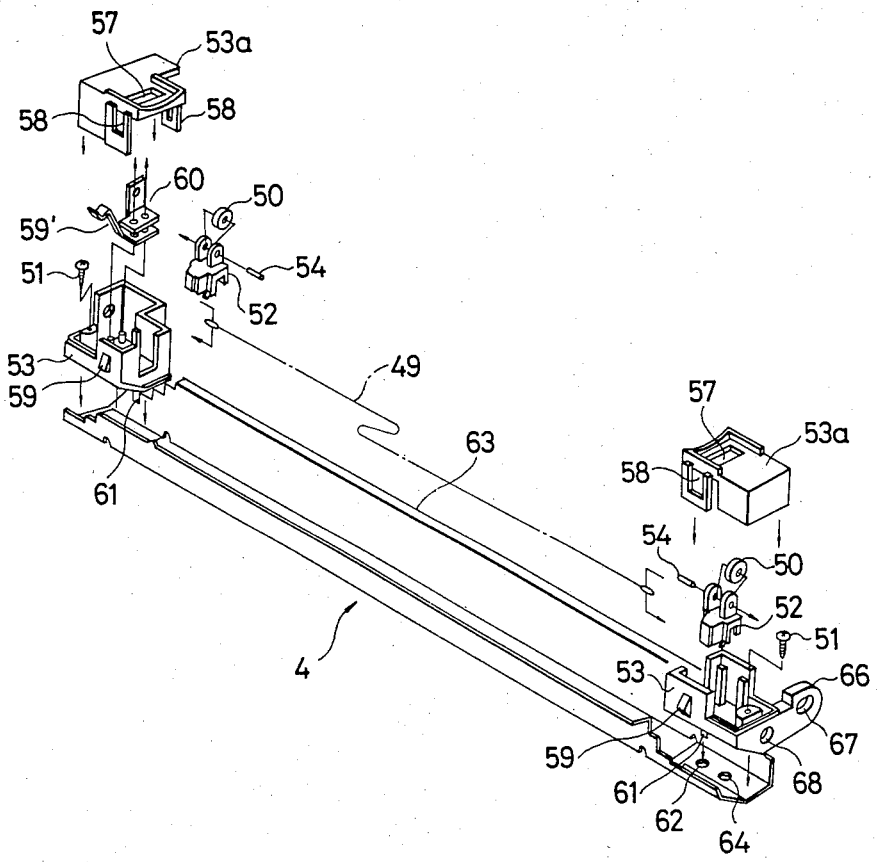
FIG. 13 is an exploded and perspective view showing the detailed construction of the corona discharger.

FIG. 13 is an exploded and perspective view showing the detailed structure of the corona discharger in a position in which it is opened upwardly.

In the arrangement shown in FIG. 13, each of the blocks 53 is made of an insulation material such as Noryl resin and fixedly secured to the shield case 63 of metal such as stainless steel as by ultrasonic welding. Each of the insulation blocks 53 has an opening to the photosensitive drum, which is closed by a cover **53*a*. The cover 53*a* has a window 57 formed therein and being of such a dimension that the roller 50 extends outwardly therethrough whereas the slide piece supporting that roller does not pass through the window. Each of the covers 53*a* includes guiding abutments 58 formed therein at the opposite sides which engage with the respective projections 59 formed on the outer side walls of the insulation block 53. By attaching such covers 53*a* to the respective insulation blocks 53, the slide pieces 52** will not fall out of the respective blocks even if the corona discharger is positioned with the covers being directed downwardly.

Each of the insulation blocks 53 receives a spring electrode 59' and a mounting plate 60 which are fixedly disposed therein. The spring electrode 59' connects one end of the discharging wire with a stationary pin 51. The mounting plate 60 is used to mount a connector pin which connects with the connector of an external power supply which will be described hereinafter.

Each of the insulation blocks 53 includes a pin-like projection 61 formed therein at the bottom which functions to guide the corona discharger when it is mounted on the wall of the process kit 30.

Figure 14:
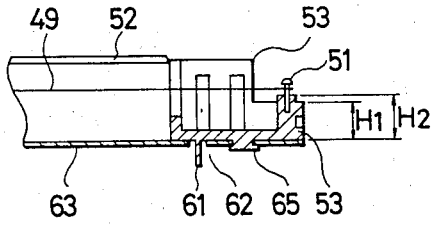
FIG. 14 is a cross-sectional view showing an insulation block in the corona discharger of FIG. 13.

As shown in FIG. 13, the shield case 63 has small apertures 62 formed therein at the opposite ends, through which the guide pins 61 on the insulation blocks pass. Other small apertures 64 formed in the shield case 63 are used to attach the insulation blocks to the shield case 63. As shown in FIG. 14, a protrusion 65 on each of the insulation blocks 53 passes through one of the small aperture 64 (FIG. 13) on the shield case 63 and is then fixed at the outer extremity to the shield case 63 under the action of high-frequency heating and pressure. Further, each of the insulation blocks 53 includes a positioning portion 66 formed therein at the outer side, which portion 66 has positioning apertures 67 and 68 formed therein.

Figure 15:
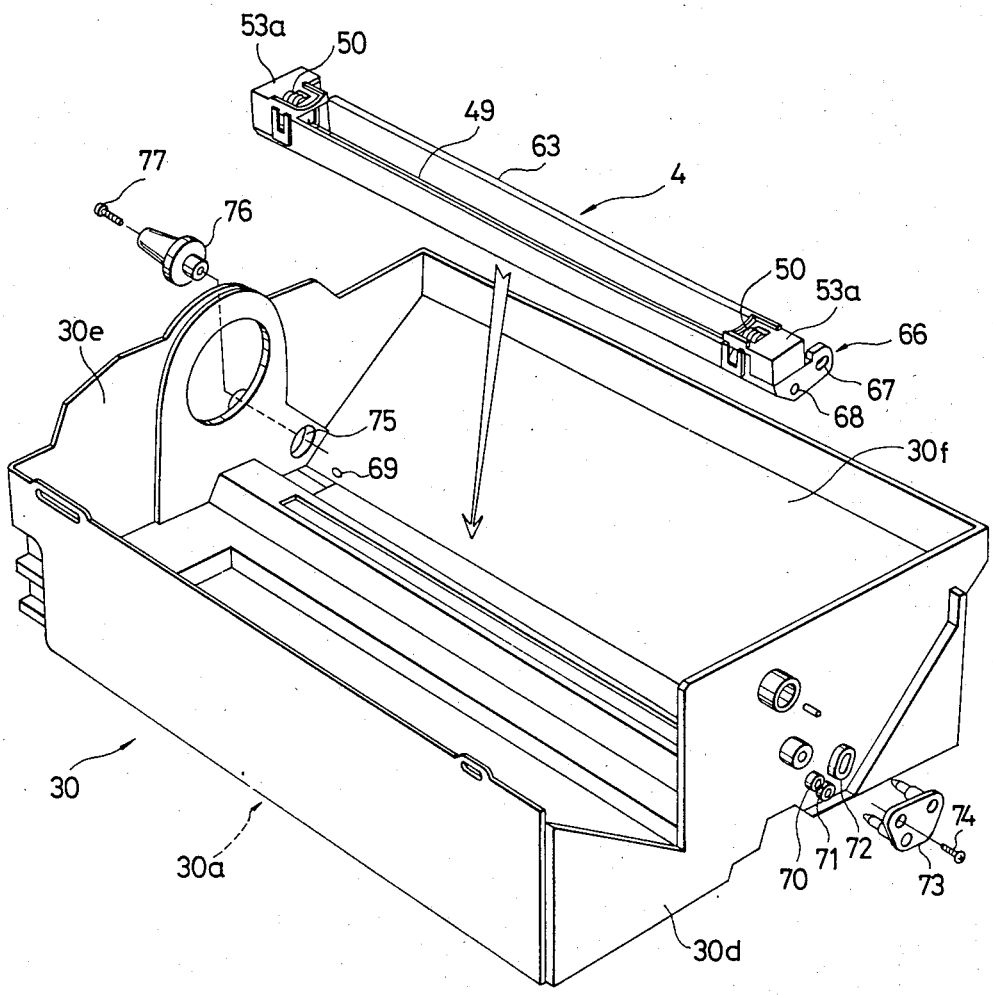
FIG. 15 illustrates the procedure of mounting the discharger in the housing of the process kit.

A procedure in which the corona discharger 4 is positioned in place by the use of these positioning portions 66 and attached to the wall of the process kit 30 will now be described in connection with FIG. 15. FIG. 15 shows the corona discharger 4 in a position in which its opening for corona-discharging is upwardly opened. Therefore, the process kit housing 30 is also shown in its upside down position.

The process kit housing 30 includes side walls 30*d* and 30*e* between which the corona discharger 4 is located. The side walls 30*d* and 30*e* are connected with each other by means of a ceiling plate 30*f* which has a pair of guide openings 69 (only one shown) formed therein for receiving the guide pins on the corona discharger 4.

The side wall 30*d* includes a threaded opening 70 and small apertures 71, 72 for receiving positioning shafts.

If the corona discharger 4 is moved into the process kit housing 30 between the side walls thereof as shown by arrow in FIG. 15, the guide pins enter the guide openings. Thus, the corona discharger 4 is set within the process kit housing with the discharging opening thereof directed to the desired direction. Subsequently, the positioning shafts on the positioning plate 73 are inserted into the small apertures 71, 72 on the side wall 30*d* and then into the positioning apertures 68, 67 on the corona discharger, respectively. Thereafter, the positioning plate 73 is fastened to the side wall 30*d* by means of a screw 74.

On the other hand, the side wall 30*e* of the process kit housing 30 has an aperture 75 formed therein for receiving an electrode bushing 76. The electrode bushing 76 is fastened to the opposite insulation block 53 of the corona discharger 4 by means of a screw 77. This screw 77 is electrically connected with the above mounting plate 60 to complete an electric circuit connecting the external power supply to the corona discharging wire 49.

Figure 16:
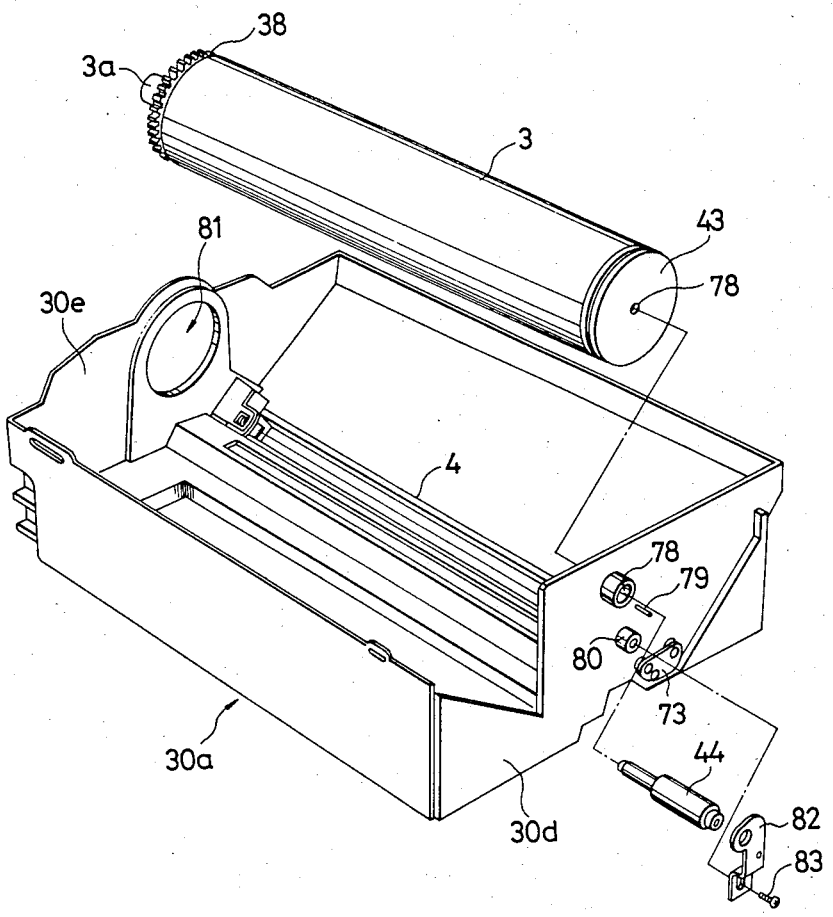
FIG. 16 illustrates the procedure of mounting the photosensitive drum in the same housing after the discharger is mounted therein.

After the corona discharger 4 is set in the process kit housing 30 in such a manner, the photosensitive drum 3 is then mounted in the same housing as shown in FIG. 16.

The photosensitive drum 3 includes a hole 78 for receiving the stub shaft 44, which hole is formed on one end face of the drum at the center thereof. The opposite end face of the drum 3 has the boss 3*a* for receiving the central bearing which in turn receives the shaft of the machine. The gear 38 is fixedly secured to the drum 3 at the end thereof that the boss 3*a* is provided. The gear 38 is drivingly connected with the driven gears on the development and cleaning devices which are not shown in FIG. 16. When the drum 3 is rotated, the gear 38 also is rotated in the same direction to drive the development and cleaning devices.

The side wall 30*d* of the process kit housing 30 also includes a positioning aperture 78, a positioning pin 79 and a threaded hole 80 all of which are formed therein. The other side wall 30*e* has an opening 81 formed therein which is a diameter slightly smaller than the external diameter of the gear 38 on the photosensitive drum. After the stub shaft 44 (FIG. 8) is inserted into the positioning hole 78 on the photosensitive drum 3, a positioning plate 82 is fixed to the side wall 30*d* by means of a screw 83 to set the photosensitive drum 3 in position. When the photosensitive drum 3 is so mounted in the process kit housing 30, the rollers 50 of the corona discharger 4 will engage with the surface of the drum under the resilience of the discharging wire 49.

In the above arrangement, thus, the discharging wire 49 can be positioned at the desired position spaced away from the member to be charged, that is, the photosensitive drum simply by setting the corona discharger relative to the photosensitive drum. Therefore, any adjustment operation will not be required on manufacturing the assembling. In addition, since the corona discharger directly determines the spatial position of the discharging wire itself, the discharging wire can be located at the desired position in the process kit independently of any tolerance in an image forming apparatus in which the corona discharger is to be mounted.

It is to be understood that the above corona discharger is simple in construction and suitable for mass production in any automated assembling line. It is further noted that the corona discharger of the present invention can be used for any other photosensitive member having an insulation body or a surface insulation layer, other than the above-mentioned photosensitive drum.

Figure 17:
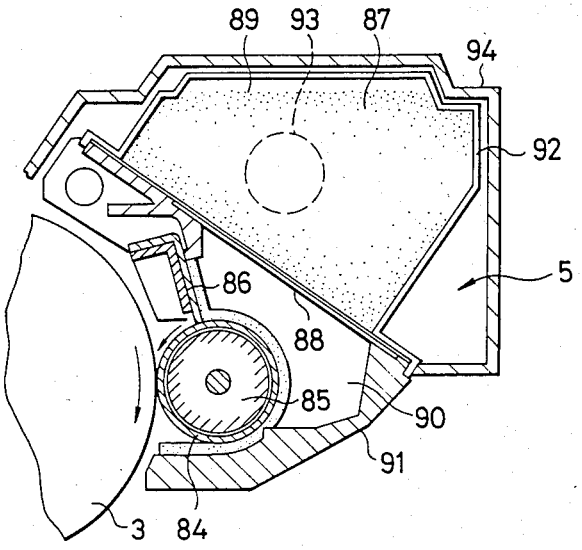
FIG. 17 is a cross-sectional view of a development device.

FIG. 17 is a cross-section of the development device which utilizes a developer such as a magnetic one-component toner. The development device comprises a cylindrical development sleeve 84 of non-magnetic material such as aluminium, stainless steel or the like which is rotated clockwise as viewed in FIG. 17. The sleeve 84 includes a magnet roller 85 which is inserted thereinto and adapted to move the magnetic toner toward the surface of the sleeve.

The toner is deposited on the sleeve surface with a proper thickness under the magnetic force of a magnet 85 and by means of a magnetic blade 86 which is also an member for controlling the thickness of toner. The toner so applied to the surface of the sleeve 84 adheres to an electrostatic latent image on the photosensitive drum 3 to develop it under the electrostatic force of the latent image and by means of an alternating bias from the connector 39 (FIG. 7) when the sleeve is positioned with the toner thereon faced to the photosensitive drum.

The amount of the toner 87 contained in the development device is determined in consideration of the durability of the photosensitive drum 3 such that a small amount of toner will remain in the development device after the photosensitive drum has been used for its limitation of effective use. The interior of the development device is divided into two chambers, a toner storage chamber 89 which can also be used as a hopper and a toner applying chamber 90 which is used to apply the toner to the surface of the drum by means of a partition plate 88 before the process kit is mounted in the machine. The toner is applied to the drum surface from the chamber 90 under the influence of the sleeve 84 and magnet 85. When it is desired to insert the process kit into the machine, the partition plate 88 is removed from the kit by grasping and pulling outwardly the end 88*a* of the plate which extends outwardly from the side wall of the development device 5. If the partition plate 88 is removed, the toner falls from the storage chamber to the applying chamber so that the latter will be filled with the toner to prepare for formation of images.

The toner is charged in the development device according to the following procedure. The development device includes a lower housing 91 and an upper housing 82 defining the storage chamber, which housings are jointed with each other as by ultrasonic welding or powerful adhesive while positioning the partition plate between the housings 91 and 92. Thus, the storage and applying chambers 88 and 90 are separated from each other by the partition plate 88.

Thereafter, a predetermined amount of toner is poured into the storage chamber 88 through an inlet 93 on the side of the upper housing 92. The inlet port 93 is then closed by a cap. Finally, the upper housing 92 is completely closed by a cover housing 94 which is fixedly secured to the upper housing as by screws or adhesive. Thus, the inlet port 93 and the cap closing it are of course invisible and untouchable. Therefore, the toner cannot be replenished to the development device. If the development device is emptied of the toner, the process kit must be replaced by a new process kit. In this manner, the quality of images reproduced by the present machine can always be maintained at high level.

Figure 18:
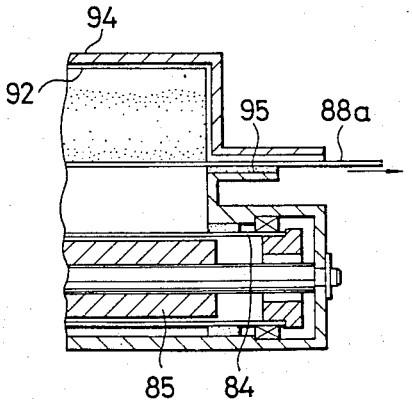
FIG. 18 is a front cross-section of the development device as seen from the side thereof from which a partition plate is removed.

The partition plate may be of any suitable heat seal synthetic resin sheet or plate. If a packing member 95 is located between the partition plate 88 and the housing as shown in FIG. 18, it is advantageous in that the toner particles will not scatter outside the development device.

Figure 19:
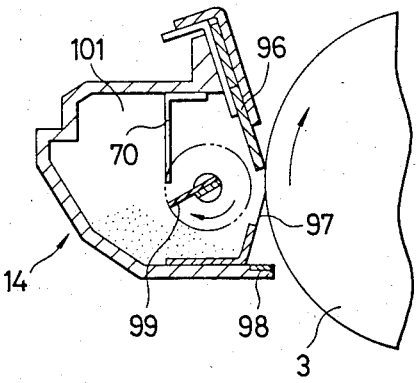
FIG. 19 is a cross-sectional view of a cleaning device.

FIG. 19 is a cross-section of the cleaning device 14 which includes a blade of rubber 96 for scraping the remaining toner particles away from the surface of the photosensitive drum 3 after a transferring step. The scraped toner particles is moved into a vessel through a scooping sheet 97 which is located immediately below the blade 96 and may be of a polyester film having a thickness of about 75 μ. The scooping sheet 97 softly engages with the surface of the drum 3 under a small pressure so that the remaining toner particles can pass under the scooping sheet. Thus, the toner particles scraped away from the drum is prevented from leaking out of the vessel by means of the scooping sheet 97. The cleaning device also includes a magnet 98 located outside the bottom of the vessel for collecting any possible leaked toner particles.

The cleaning device 14 further includes a partition plate partially dividing the vessel into a forward chamber in which a raking blade 99 is rotatably located and a rearward chamber 101. After the toner particles have been scraped away from the photosensitive drum 3, they are forced into the rearward chamber 101 under the action of the raking blade 99. The apparent density of the toner is thus increased so that the vessel can be reduced in size. The raking member 99 may be made of an elastic material such as a polyester sheet, a rubber-impregnated cloth or the like, and is driven through the transmitting gear 38 on the photosensitive drum engaged with gear provided at cleaning device.

What is claimed is:

1. A corona discharger system comprising a corona wire; means for supporting both ends of the corona wire; a member movable into facing relation with said corona wire and having a surface which will hold an electrostatic latent image; and corona wire positioning member located between said surface and the mounted corona wire and always biased toward said surface by the tension of said wire.

2. A corona discharger system comprising a corona wire; means for supporting both ends of the corona wire; a member movable into facing relation with said corona wire and having a surface which will hold an electorstatic latent image; and corona wire positioning member located between said surface and the mounted corona wire and always biased toward said surface by utilizing the tension of said corona wire and having a roller facing said surface.

3. A corona discharging system comprising a corona wire; means for supporting both ends of the corona wire so as to tension said corona wire; a member movable into facing relation with said corona wire and having a surface which will hold an electrostatic latent image; a corona wire positioning member biased by the tension of said corona wire in the direction of said member; and guide means to adjust the range of movement of said corona wire positioning member.

4. A corona discharger system according to claim 3, wherein said corona wire positioning member sets the position of said corona wire by abutting with said surface of said member and pushing up said corona wire.

5. A corona discharger system according to claim 3, wherein said guide means controls the movement of said corona wire positioning member in the direction biased by said corona wire.

6. A corona discharger system according to claim 3, wherein said guide means rotatably supports said corona wire positioning member.

7. A corona discharger system comprising a corona wire; means for supporting both ends of said corona wire so as to tension said wire; a member movable into facing relation with said corona wire and having a surface which will hold an electrostatic latent image; a corona wire positioning member biased to the direction of said member by the tension of said corona wire and provided with a roller member at a side opposite to said corona wire; and guide means to control the range of the movement of said corona wire positioning member.

8. A corona discharger system according to claim 7, wherein said corona wire positioning member sets the position of the corona wire by abutting said roller member with said surface of said member facing the corona discharger to push up the corona wire.

9. A corona discharger system according to claim 7, wherein said guide means controls the movement of said corona wire positioning means biased by said wire.

10. A corona discharger according to claim 7, wherein said guide means rotatably supports said corona wire positioning member.

* * * * *